US007865094B2

(12) United States Patent
Murakami

(10) Patent No.: US 7,865,094 B2
(45) Date of Patent: Jan. 4, 2011

(54) IMAGE FORMING APPARATUS

(75) Inventor: Reiji Murakami, Yokohama-shi (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 783 days.

(21) Appl. No.: 11/678,193

(22) Filed: Feb. 23, 2007

(65) Prior Publication Data

US 2008/0205918 A1 Aug. 28, 2008

(51) Int. Cl.
*G03G 15/00* (2006.01)

(52) U.S. Cl. ..... 399/45

(58) Field of Classification Search ..... 399/45
See application file for complete search history.

(56) References Cited

U.S. PATENT DOCUMENTS

2005/0074248 A1 * 4/2005 Akita et al. ..... 399/45

* cited by examiner

*Primary Examiner*—David M Gray
*Assistant Examiner*—Erika Villaluna
(74) *Attorney, Agent, or Firm*—Turocy & Watson, LLP

(57) ABSTRACT

With respect to principal papers distributed in the market and used in an image forming apparatus, a boundary between grammage ranges is set at the center of a section where neighboring grammage values of paper has a large difference, and an image is formed under optimum image forming conditions in accordance with the determined grammage range.

3 Claims, 4 Drawing Sheets

FIG.4

| PAPER TYPE | GRAMMAGE RANGE (g/m²) | GRAMMAGE (g/m²) | DISTRIBUTION JAPAN | DISTRIBUTION NORTH AMERICA | DISTRIBUTION EUROPE | REAM WEIGHT BY KILOGRAM (kg) | REAM WEIGHT BY U.S. POUND (lbs.) |
|---|---|---|---|---|---|---|---|
| PLAIN PAPER | 64～105 | 64.0 | ○ | | | 55 | |
| | | 75.3 | | ○ | | | 20(Bond) |
| | | 80.0 | | | ○ | | |
| | | 81.4 | ○ | | | 70 | |
| | | 90.0 | | | ○ | | |
| | | 90.3 | | ○ | | | 24(Bond) |
| | | 100.0 | | | ○ | | |
| | | 104.7 | ○ | | | 90 | |
| | | 105.4 | | ○ | | | 28(Bond) |
| CARDBOARD 1 | 106～163 | 120.0 | | | ○ | | |
| | | 120.4 | | ○ | | | 32(Bond) |
| | | 127.9 | ○ | | | 110 | |
| | | 135.3 | | ○ | | | 50(Cover) |
| | | 157.0 | ○ | | | 135 | |
| | | 160.0 | | | ○ | | |
| | | 162.4 | | ○ | | | 60(Cover) |
| | | 162.9 | | ○ | | | 90(Index) |
| CARDBOARD 2 | 164～209 | 175.9 | | ○ | | | 65(Cover) |
| | | 199.1 | | ○ | | | 110(Index) |
| | | 200.0 | | | ○ | | |
| | | 209.3 | ○ | | | 180 | |
| CARDBOARD 3 | 210～256 | 216.5 | | ○ | | | 80(Cover) |
| | | 220.0 | | | ○ | | |
| | | 250.0 | | | ○ | | |
| | | 255.9 | ○ | | | 220 | |
| CARDBOARD 4 | 257～300 | 280.0 | | | ○ | | |
| | | 300.0 | | | ○ | | |

IMAGE FORMING APPARATUS

BACKGROUND OF THE INVENTION

1. Field of the Invention

The present invention relates to an image forming apparatus having a function of determining the type or the like of a recording target medium.

2. Description of the Related Art

In an image forming apparatus, various types of sheets as recording target media are used such as plain papers, thin papers, and cardboards. As a way of classifying the sheets, the sheets are divided into several types of groups depending on the grammage, which is the weight per unit area of the sheet, and optimum printing conditions may be set for each group. Image forming conditions to form an image such as the speed of carrying a recording medium, the transfer voltage used for transferring a toner image, and the optimum temperature for fixing a toner image by a fixing device, are adjusted in accordance with the thickness of the sheet.

Typically, a user selects a group of classified sheets, for example, from a control panel of the image forming apparatus. The types of sheet can be roughly divided into plain paper and cardboard. The cardboard may also be further divided into three to four types.

Recently, an image forming apparatus has been proposed in which a sensor to determine the paper type (hereinafter referred to as a medium sensor) is installed and which does not need user's manual operation for the selection of a paper type.

The material characteristics of a sheet to be detected by the medium sensor are material characteristics other than grammage, such as thickness and light transmittance. At present, there is no proper sensor that can directly detect grammage and that can be mounted on an image forming apparatus.

Generally, since grammage is printed on a package of sheets, it is a measure that is easy to use when the paper type is to be identified by the user. However, the medium sensor is to identify the paper type by a different measure such as thickness or light transmittance, and therefore it has a problem that misidentification easily occurs.

BRIEF SUMMARY OF THE INVENTION

It is an object of the present invention to provide an image forming apparatus in which a medium sensor that carries out type determination of a recording target medium is installed.

In an aspect of the present invention, an image forming apparatus that forms an image on a recording target medium, includes:

an image forming unit;

a medium sensor configured to determine a type of a recording target medium;

a determining unit configured to convert an output of the medium sensor to grammage, and classify and determine a grammage value within a predetermined range as a predetermined grammage range; and a control unit configured to change an image forming condition in accordance with the grammage range determined by the determining unit;

wherein if neighboring grammage values of different types of recording target media have a large difference, the grammage range is classified at the center of that section.

DESCRIPTION OF THE DRAWINGS

FIG. 4 is a table that compares sheets available to a user in Japan, North America, and Europe.

DETAILED DESCRIPTION OF THE INVENTION

Throughout this description, the embodiments and examples shown should be considered as exemplars, rather than limitations on the apparatus and methods of the present invention.

Hereinafter, an embodiment of an image forming apparatus according to the invention will be described in detail with reference to the drawings.

Figure 1:
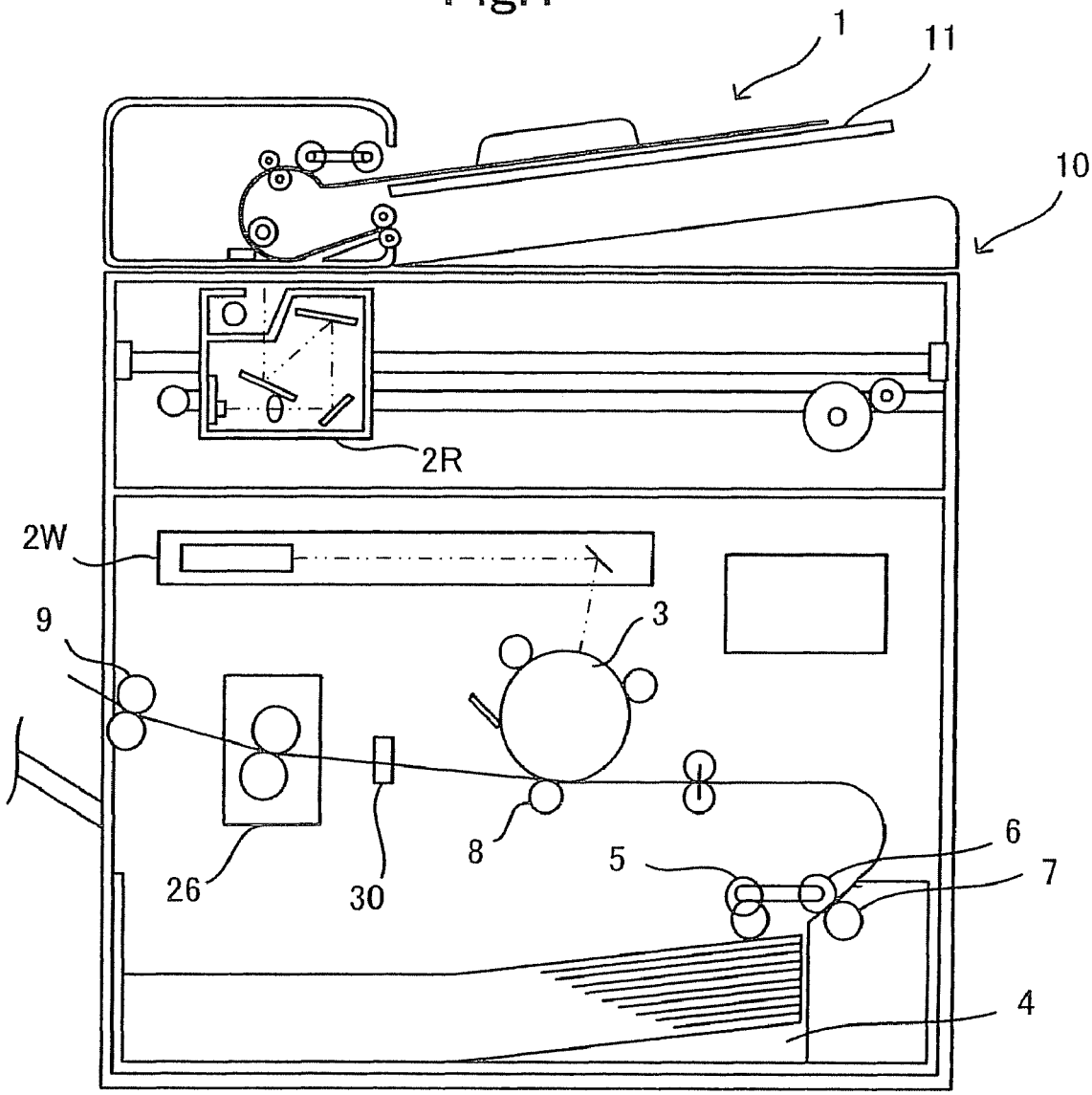
FIG. 1 is a configuration view showing an exemplary image forming apparatus.

FIG. 1 is a configuration view showing an embodiment of the image forming apparatus. An image forming apparatus 10 has an automatic document feeder (ADF) 1 that automatically feeds an original loaded by a user, an image reading device (hereinafter referred to as scanner unit) 2R that reads an image of an original set on an original setting table 11 of the ADF 1 and sent from the original setting table 11, and a photoconductive drum (latent image carrier) 3 that performs image processing to the image read by the image reading device 2R and then is irradiated with a laser beam in accordance with a recording signal. As this photoconductive drum 3 is irradiated with a laser beam by a laser scanner (exposure means) 2W for image writing, a latent image is formed.

The image forming apparatus 10 also has a cassette 4 that houses sheets (recording media) such as papers or films, a pickup roller 5 to carry a sheet to the photoconductive drum 3, a carrier roller 6, and a separation roller 7. Here, the sheets housed in the cassette 4 are picked up by the pickup roller 5 in accordance with a recording signal, and the sheets are supplied one by one to a position facing the photoconductive drum 3, by the carrier roller 6 and the separation roller 7.

Moreover, the image forming apparatus 10 has a transfer device 8 that transfers, onto a sheet, a toner image formed by development means with toner supplied from a toner supply device, not shown, a fixing device 26 that fixes the toner image transferred to the sheet, a medium sensor 30 that is arranged, for example, in a sheet carrying path on the upstream side (paper feeding side) of the fixing device 26 and determines the type of the sheet, a discharge roller 9 that is provided on the downstream side of the fixing device 26 and discharges the sheet on which fixing of the toner image is completed, to a discharge tray installed outside of the image forming apparatus 10, and so on.

Figure 2:
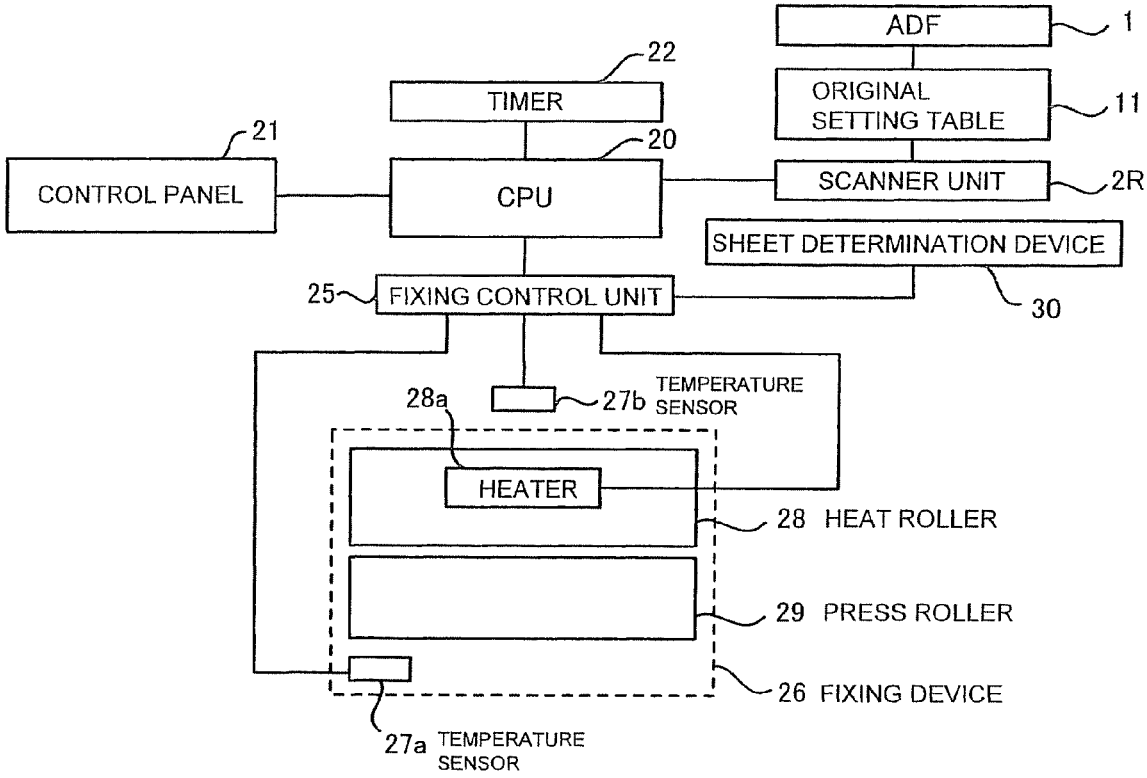
FIG. 2 is a block diagram showing the configuration of essential parts of a control system of the image forming apparatus of FIG. 1.

FIG. 2 is a block diagram showing the configuration of essential parts of a control system of the image forming apparatus 10.

The control system of the image forming apparatus 10 has a central processing unit (CPU) 20, a control panel 21, a timer 22, the ADF 1, the scanner unit 2R, a fixing control unit 25, and the fixing device 26. Moreover, the fixing device 26 has temperature sensors 27*a* and 27*b*, a heat roller 28 with a built-in heater 28*a*, and a press roller 29.

The CPU 20 controls the overall operations of the image forming apparatus 10 and is connected to the control panel 21, the timer 22, the scanner unit 2R, and the fixing control unit 25. Here, the CPU 20 and the fixing control unit 25 form a control unit that control all the operations.

The fixing control unit 25 performs control related to the setting of the fixing temperature of the fixing device 26 and the fixing power to be supplied, on the basis of the result of detection by the medium sensor 30.

In the fixing device 26, the temperature sensor 27*b* is arranged near the heat roller 28 that is heated by the heater 28*a*, and the temperature sensor 27*b* detects its temperature and notifies the fixing control unit 25 of the temperature.

The temperature sensor 27*a* is arranged near the press roller 29, and detects its temperature and notifies the fixing control unit 25 of the temperature.

The medium sensor 30 measures, for example, the thickness of a sheet that is a recording target medium. There are various kinds of techniques for measuring the thickness. For example, a measuring technique using a distance measuring sensor is known. The distance measuring sensor is called, for example, position sensitive detector (PSD). It casts light from a light emitting element to a sheet and measures the distance on the basis of the incident position on the sensor of the reflected light from the sheet. The measuring technique using the distance measuring sensor is described in detail, for example, in Japanese Patent No. 3,524,755.

With the distance measuring sensor, the thickness of the paper can be directly measured, or the quantity of vertical displacement of the paper carrier roller can be measured by using the distance measuring sensor and the thickness of the paper can be indirectly measured.

Also, a pair of combination electrodes that can nip a supplied sheet may be arranged on the carrying path of the paper feed unit, and a change in the electrostatic capacity between the electrodes can be detected.

The material characteristics of a sheet to be detected by the medium sensor 30 are material characteristics other than grammage, such as the thickness of paper and light transmittance. Grammage represents reference weight of a paper or board, and it refers mass per unit area. That is, the area and mass of a paper is measured and it is converted to mass per unit area. The unit is expressed by $g/m^2$. Usually, it can be said that a paper with a large grammage value is a "thick", "heavy", "rigid (strong)" and "hard" paper, and conversely a paper with a small grammage value is a "thin", "light", "flexible (weak)" and "soft" paper.

Generally, grammage is printed on a package of sheets and therefore it is a measure that is easy to use when the user identifies the paper type. However, since the medium sensor cannot directly detect grammage and identifies the paper type by using a different measure such as the thickness and light transmittance, misidentification easily occurs.

Causes of misidentification will be described specifically with respect to the thickness of paper as an example. The thickness of paper and grammage are in the relation of "grammage=thickness of paper×density". It can be considered that grammage and thickness of paper are substantially in a linear relation. However, this does not necessarily apply to all the sheets available to users in the market and used. This is because the density differs depending on the paper type, and it is due to the difference in the material and manufacturing method.

At present, there can be found no proper sensor that can directly detect grammage and that can be mounted on an image forming apparatus.

An output of the medium sensor 30 is sent to a determining unit. The determining unit converts the output of the medium sensor 30 into grammage and classifies a grammage value in a predetermined range as a predetermined grammage range. Therefore, for a sheet detected by the medium sensor 30, the determining unit determines to which grammage range the sheet belongs. Here, a grammage range is classified at the center of a section where neighboring grammage values of different types of sheets have a large difference. This grammage range will be described in detail later.

In accordance with the grammage range determined by the determining unit, optimum image forming conditions are transmitted to the fixing control unit of the image forming apparatus. The fixing control unit controls the fixing unit in accordance with the grammage range.

Figure 3:
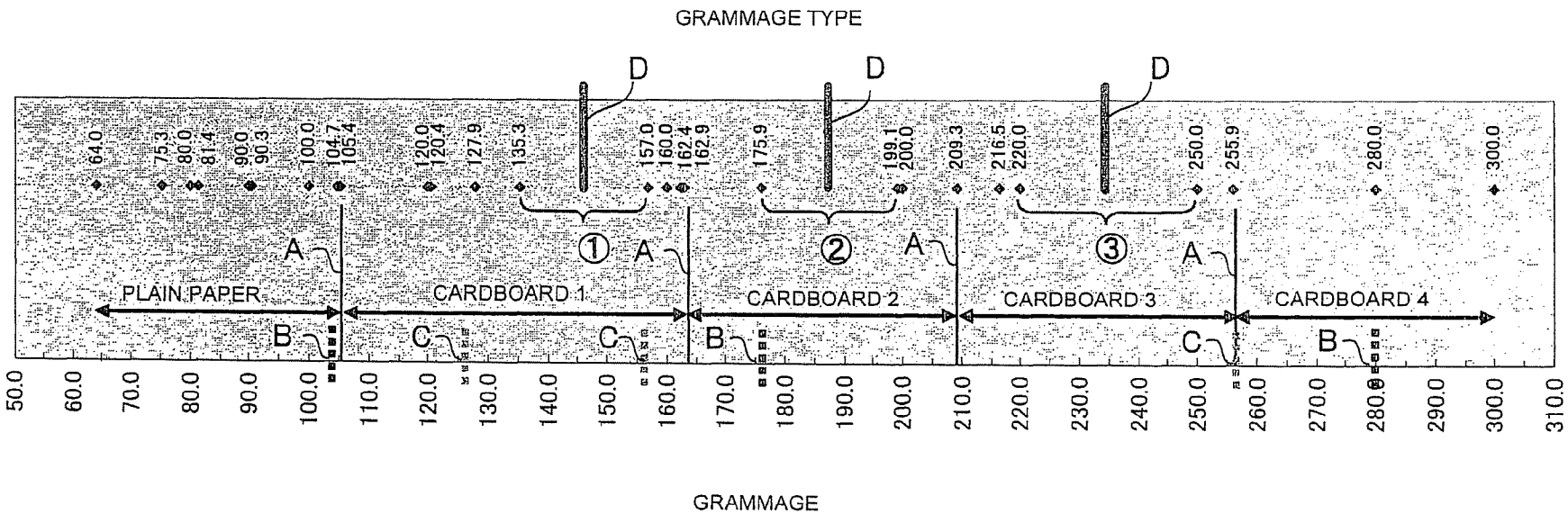
FIG. 3 is a view for explaining the setting of a grammage range according to an embodiment of the invention.

FIG. 3 is an explanatory view showing the relation between "grammage" (gram per square meter; $g/m^2$), "grammage type", and "grammage range".

That is, "grammage" of principal sheets (used in MFP) distributed in the market is plotted at each predetermined position corresponding to the "grammage" value. "Grammage types" do not randomly exist. The grammage of the sheets distributed in Japan, the United States and Europe is substantially limited to the "grammage type" shown in FIG. 3.

FIG. 4 shows a list in which comparison of the sheets distributed mainly in the Japanese, North American and European markets is shown by circular symbols, with reference to Company A, which will be described later, corresponding to FIG. 3.

In FIG. 4, the term "ream weight" is used. "Ream weight" means the weight of 1,000 sheets of paper (one ream) finished in a predetermined dimension. The unit is expressed by "kg/ream". In U.S. pound, 5,000 sheets of paper constitute one ream and it is expressed by "U.S. pound/ream".

As for the fixing conditions in the image forming apparatus, all of them may be made to correspond for each "grammage type", but there are a number of "grammage types" and this work is complicated and impractical. Therefore, the "grammage types" in a predetermined range are collectively handled as a "grammage range", and fixing conditions are set for each "grammage range".

For the width of this "grammage range", there is no standard that is uniformly decided in the industry, and each manufacturer has arbitrarily set a range. For example, the range indicated by the solid line is of Company A, the range indicated by the dotted line is of Company B, and the range indicated by the chain-dotted line is of Company C. In the case of Company A, the paper types corresponding to the respective "grammage types" are called, for example, plain paper, cardboard 1, cardboard 2, cardboard 3, and the like.

When the boundaries between "grammage ranges" in the table shown in FIG. 4 are watched, the "grammage types" are separated by the maximum numeric value in one "grammage range" and the minimum numeric value in the next "grammage range" that are in an approximate numeric value range. The detection of "grammage" varies even if it is detected by the above-described medium sensor or the like. The detection cannot always be done accurately. Therefore, in the case where "grammage types" are approximate to each other, which one of the "grammage types" is the proper one cannot be decided when the result of detection varies. In this case, if the boundary between the "grammage ranges" exists between the varying "grammage types", the "grammage range" may differ even for the approximate "grammage type", and therefore the fixing conditions differ.

In this embodiment, a "grammage range" is set in an area having a difference of at least 20 $g/m^2$ or more from the numeric value of the next "grammage type".

That is, the steps of setting "grammage ranges" include the following two steps. First, an area is extracted which has a difference of 20 $g/m^2$ or more from the next "grammage type" in a table showing a list of "grammage types" in order of numeric values (step 1).

Next, each "grammage range" is set in the extracted area (step 2).

Thus, a boundary D between "grammage ranges" is in an area between "grammage types" of 135.3 g/m$^2$ and 157.0 g/m$^2$. A boundary E between "grammage ranges" is in an area between "grammage types" of 175.9 g/m$^2$ and 199.1 g/m$^2$. A boundary F between "grammage ranges" is in an area between "grammage types" of 220.0 g/m$^2$ and 250.0 g/m$^2$.

In short, the difference between the "grammage types" in the respective areas where the boundaries D, E and F are set, is as follows:

157.0 g/m$^2$−135.5 g/m$^2$=21.7 g/m$^2$ for the boundary D between "grammage ranges";

199.1 g/m$^2$−175.9 g/m$^2$=23.2 g/m$^2$ for the boundary E between "grammage ranges"; and 250.0 g/m$^2$-220.0 g/m$^2$=30.0 g/m$^2$ for the boundary F between "grammage ranges".

In each case, the difference between "grammage types" is 20 g/m$^2$ or more. Therefore, even when the result of detection by the above-described medium sensor varies, the result of detection can be securely classified into a predetermined "grammage range" on the basis of the division with the grammage range boundary, and the risk of misidentification of the paper type can be reduced.

As a result, in the image forming apparatus, a formed image can be fixed to a sheet under proper fixing conditions corresponding to each sheet.

Although exemplary embodiments of the present invention have been shown and described, it will be apparent to those having ordinary skill in the art that a number of changes, modifications, or alterations to the invention as described herein may be made, none of which depart from the spirit of the present invention.

All such changes, modifications, and alterations should therefore be seen as within the scope of the present invention.

What is claimed is:

1. An image forming apparatus that forms an image on a recording target medium, comprising:

an image forming unit;

a medium sensor configured to determine a type of a recording target medium;

a determining unit configured to convert an output of the medium sensor to grammage, and classify and determine a grammage value within a predetermined range among a plurality of predetermined grammage ranges, each predetermined grammage range separated by a boundary, and where the medium sensor is susceptible to medium classification error; and a control unit configured to change an image forming condition in accordance with the grammage range determined by the determining unit;

wherein the boundary between each predetermined grammage range is set at a grammage value that minimizes the possibility of medium classification error by the medium sensor, the boundary determined by 1) extracting one or more extracted areas from a table of media type grammage available, each extracted area defined as a range of grammage values between neighboring available media types on the table with a difference in grammage value of 20 g/m$^2$ or more between the neighboring media types, and where no available media type has a grammage value that falls within the one or more extracted areas; and 2) setting the boundary between predetermined grammage ranges at the center of the one or more extracted areas.

2. The image forming apparatus according to claim 1, wherein the grammage range is classified on the basis of actual grammage of a recording target medium available to a user.

3. The image forming apparatus according to claim 1, wherein in the grammage range, neighboring numeric values of grammage are set in respective sections between 135.3 g/m$^2$ and 157.0 g/m$^2$, between 175.9 g/m$^2$ and 199.1 g/m$^2$, and between 220.0 g/m$^2$ and 250.0 g/m$^2$.

* * * * *